US007670240B2

(12) United States Patent
Pitts et al.

(10) Patent No.: US 7,670,240 B2
(45) Date of Patent: Mar. 2, 2010

(54) ELEVATOR BELT ASSEMBLY WITH NOISE REDUCING GROOVE ARRANGEMENT

(75) Inventors: John Pitts, Avon, CT (US); Bruce Swaybill, Farmington, CT (US); Patricia A. Derwinski, Farmington, CT (US); Hugh James O'Donnell, Longmeadow, MA (US)

(73) Assignee: Otis Elevator Company, Farmington, CT (US)

( * ) Notice: Subject to any disclaimer, the term of this patent is extended or adjusted under 35 U.S.C. 154(b) by 522 days.

(21) Appl. No.: 09/970,587

(22) Filed: Oct. 4, 2001

(65) Prior Publication Data

US 2003/0069101 A1 Apr. 10, 2003

(51) Int. Cl.
*F16G 9/04* (2006.01)

(52) U.S. Cl. ..... 474/237; 474/260; 474/153; 156/137

(58) Field of Classification Search ..... 474/238, 474/153, 205, 263, 262, 260; 264/254, 140, 264/267, 257; 156/137; 187/266, 251, 254, 187/265, 264
See application file for complete search history.

(56) References Cited

U.S. PATENT DOCUMENTS

| | | | | | |
|---|---|---|---|---|---|
| 4,011,766 | A * | 3/1977 | Waugh | 474/238 |
| 4,486,375 | A * | 12/1984 | Hirai | 264/254 |
| 4,534,437 | A * | 8/1985 | Howerton et al. | 180/185 |
| 4,605,389 | A * | 8/1986 | Westhoff | 474/153 |
| 4,976,662 | A * | 12/1990 | Miranti, Jr. | 474/205 |
| 5,055,090 | A | 10/1991 | Miranti, Jr. | |
| 5,211,608 | A | 5/1993 | Wong et al. | |
| 5,308,291 | A * | 5/1994 | Robertson et al. | 474/252 |
| 5,382,198 | A | 1/1995 | Janne | |
| 6,364,063 | B1 * | 4/2002 | Aulanko et al. | 187/266 |
| 6,484,368 | B1 * | 11/2002 | Rivera et al. | 24/115 R |

FOREIGN PATENT DOCUMENTS

| | | | |
|---|---|---|---|
| DE | 2906619 B1 | * | 7/1980 |
| DE | 40 16 469 A1 | | 11/1991 |
| EP | 0356798 | * | 3/1990 |
| EP | 0 520 781 A1 | | 12/1992 |
| JP | 5724997 | | 5/1980 |
| JP | 08-247221 A | * | 9/1996 |
| WO | WO 00/37738 | | 6/2000 |

OTHER PUBLICATIONS

International Search Report mailed Dec. 19, 2002.

* cited by examiner

*Primary Examiner*—Marcus Charles
(74) *Attorney, Agent, or Firm*—Carlson, Gaskey & Olds PC

(57) ABSTRACT

An elevator load bearing assembly includes a plurality of cords within a jacket. The jacket has a plurality of grooves spaced along the length of the belt assembly. In one example, the grooves are separated by varying spacings along the length of the belt. In another example, at least a portion of each groove is aligned at an oblique angle relative to the longitudinal axis of the belt. Another example includes a combination of the different spacings and the non-perpendicular alignment.

10 Claims, 3 Drawing Sheets

ELEVATOR BELT ASSEMBLY WITH NOISE REDUCING GROOVE ARRANGEMENT

BACKGROUND OF THE INVENTION

1. Field of the Invention

This invention generally relates to load bearing members for use in elevator systems. More particularly, this invention relates to an elevator belt assembly having a specialized groove arrangement.

2. Description of the Related Art

Elevator systems typically include a cab and counterweight that move within a hoistway to transport passengers or cargo to different landings within a building, for example. A load bearing member, such as roping or a belt typically moves over a set of sheaves and supports the load of the cab and counterweight. There are a variety of types of load bearing members used in elevator systems.

One type of load bearing member is a coated steel belt. Typical arrangements include a plurality of steel cords extending along the length of the belt assembly. A jacket is applied over the cords and forms an exterior of the belt assembly. Some jacket application processes result in grooves being formed in the jacket surface on at least one side of the belt assembly. Some processes also tend to cause distortions or irregularities in the position of the steel cords relative to the exterior of the jacket along the length of the belt.

FIG. 8, for example, illustrates both of these phenomena. As can be seen, the spacing between the exterior of the jacket 200 and the cords 210 varies along the length of the belt. As can be appreciated from the illustration, the cords 210 are set within the jacket as if they comprise a series of cord segments of equal length corresponding to the groove spacing. The illustration of FIG. 8 includes an exaggeration of the typical physical cord layout for purposes of illustration. The actual distortions or changes in the position of the cords relative to the jacket outer surfaces may not be discernable by the human eye in some examples.

When conventional jacket application processes are used, the manner in which the cords are supported during the jacket application process tends to result in such distortion in the geometry or configuration of the cords relative to the jacket outer surfaces along the length of the belt.

While such arrangements have proven useful, there is need for improvement. One particular difficulty associated with such belt assemblies is that as the belt moves in the elevator system, the grooves and the cord placement in the jacket interact with other system components such as the sheaves and generate undesirable noise, vibration or both. For example, as the belt assembly moves at a constant velocity, a steady state frequency of groove contact with the sheaves creates an annoying, audible tone. The repeated pattern of changes in the cord spacing from the jacket outer surfaces is believed to contribute to such noise generation.

An alternative arrangement is required to minimize or eliminate the occurrence of vibrations or an annoying tone during elevator system operation. This invention addresses that need.

SUMMARY OF THE INVENTION

In general terms, this invention is a belt assembly for use in an elevator system. The belt assembly includes a plurality of cords extending generally parallel to a longitudinal axis of the belt. A jacket over the cords includes a plurality of grooves that are situated to minimize the occurrence of an annoying audible tone during elevator operation.

In one example, the grooves are longitudinally spaced such that spacings between the grooves varies along the length of the belt. Having different spacings between adjacent grooves eliminates the steady state frequency of groove contact with other system components, which is a major contributor to the potential for undesirable noise or vibration during elevator operation.

In another example, the grooves extend across the width of the jacket. At least a portion of each of the grooves is aligned to be not perpendicular to the longitudinal axis of the belt. In one example, the grooves comprise straight lines. In another example, the grooves comprise a series of line segments, each of which is at a different angle relative to the longitudinal axis of the belt.

A belt assembly designed according to this invention may include the inventive different spacings, the inventive angular alignment of the grooves or a combination of both. The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
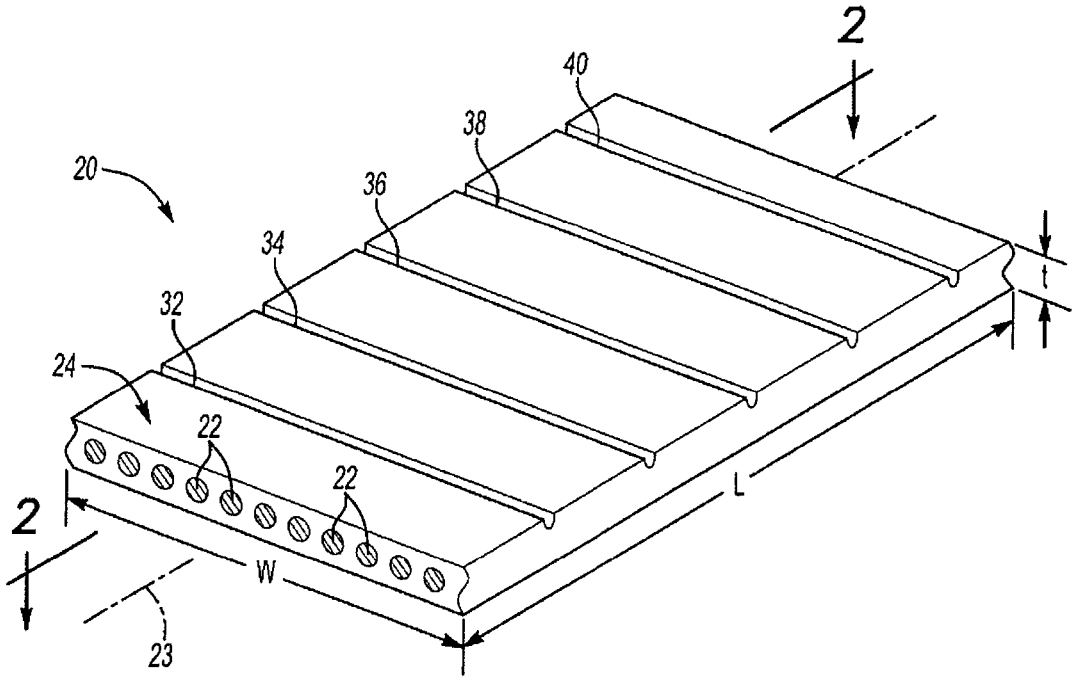
FIG. 1 schematically illustrates a portion of an example belt assembly designed according to an embodiment of this invention.
Figure 2:
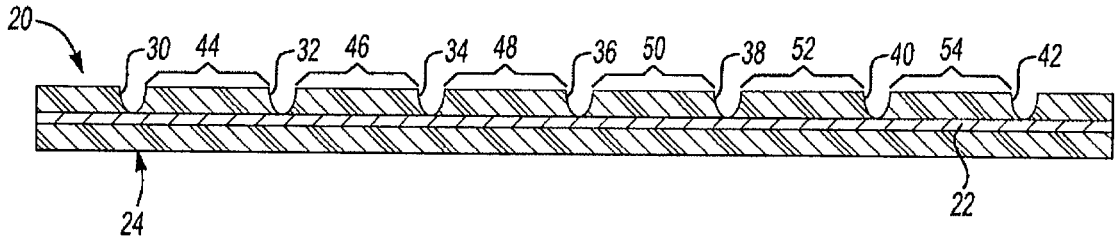
FIG. 2 is a cross-sectional illustration taken along the lines II-II in FIG. 1.

FIGS. 1 and 2 schematically illustrate a belt assembly 20 that is designed for use in an elevator system. A plurality of cords 22 are aligned generally parallel to a longitudinal axis 23 of the belt assembly 20. In one example, the cords 22 are made of strands of steel wire.

A jacket 24 covers over the cords 22. The jacket 24 preferably comprises a polyurethane-based material. A variety of such materials are commercially available and known in the art to be useful for elevator belt assemblies. Given this description, those skilled in the art will be able to select a proper jacket material to suit the needs of their particular situation.

The jacket 24 establishes an exterior length, L, width, W, and a thickness, t, of the belt assembly 20. In one example, the width W of the belt assembly is 30 millimeters, the thickness t is 3 millimeters and the depth of each groove is 0.7 millimeters. In the same example, the cords 22 have a diameter of 1.65 millimeters. The cords 22 preferably extend along the entire length L of the assembly.

The jacket 24 includes a plurality of grooves 30, 32, 34, 36, 38, 40 and 42 on at least one side of the jacket 24. In the illustrated example, the grooves extend across the entire width of the belt assembly.

The grooves result from some manufacturing processes, many of which are well known in the art, that are suitable for formation of the belt assembly 20. In the example embodiment of FIGS. 1 and 2, the grooves are spaced apart different distances so that there are different spacings between various grooves. For example, a first spacing 44 separates the groove 30 from the adjacent groove 32. A different spacing 46 separates the groove 32 from the adjacent groove 34. Similarly, the spacings 48, 50, 52 and 54 vary in size.

It is not necessary that all of the illustrated spacings are different, however, it is preferred to provide as many different spacings along the length of the belt assembly as possible. As a practical matter, a repeated pattern of the varying spacings will typically extend along the entire length of the belt assembly 20. Depending on the particulars of the belt assembly and the equipment used to form and apply the jacket 24, the pattern of different spacings will repeat at different intervals. Preferably, the interval of pattern repetition will be as large as the manufacturing equipment allows. In one example, there is a pattern of different spacings that repeats about every two meters. Within each two meter section, the spacings between adjacent grooves are selected to be varying and non-periodic.

By altering spacings between adjacent grooves, the noise component, caused by contact of the belt assembly with other elevator system components, such as the sheaves, during system operation, is spread over a broader range of frequencies. Thus, steady state frequencies of noise are avoided which eliminates the potential for an audible, annoying tone.

In addition to varying the spacing between the grooves, the inventive arrangement provides the ability to vary the lengths of cord "segments," which result from certain manufacturing techniques (but are not necessarily included in the inventive arrangement). A belt assembly designed according to this invention may include a series of cord segments along which the distance between the cord and the jacket outer surfaces varies. The ends of such cord "segments" coincide with the location of the grooves. Varying the spacing of the grooves also varies the length of the segments and therefore varies the pattern of the cord geometry relative to the jacket outer surfaces. With the inventive arrangement, the length of the cord segments varies along the length of the belt.

Because the segments are of various lengths, there is no periodic, repeated geometric pattern of the cords relative to the jacket outer surfaces. By varying the length of the cord segments (i.e., changing spacing between similar distortions in the position of the cord relative to the jacket outer surfaces) any contribution to noise or vibration caused by the cord geometry, is reduced or eliminated.

By eliminating the periodic feature of the cord geometry, this invention provides a significant advantage for reducing vibration and noise generation during elevator system operation.

FIGS. 3 through 6 illustrate various strategies according to this invention for avoiding noise levels caused by belt movement during elevator operation. The example of FIG. 3 includes a jacket 24*a* having a plurality of grooves 56. In this example, an equal spacing 58 separates adjacent grooves 56. The grooves 56 comprise straight lines extending across the width of the belt assembly. Each groove 56 is at an acute angle 60 relative to the longitudinal axis of the belt. Whether the angle of groove alignment is acute or obtuse depends only on a frame of reference. Arranging at least a portion of the grooves 56 to be non-perpendicular to the longitudinal axis of the belt avoids the steady state frequency of noise generation, that otherwise occurs when perpendicularly aligned grooves (and associated cord distortions) are equally spaced along the length of the belt.

Figures 3, 4, 5, 6:
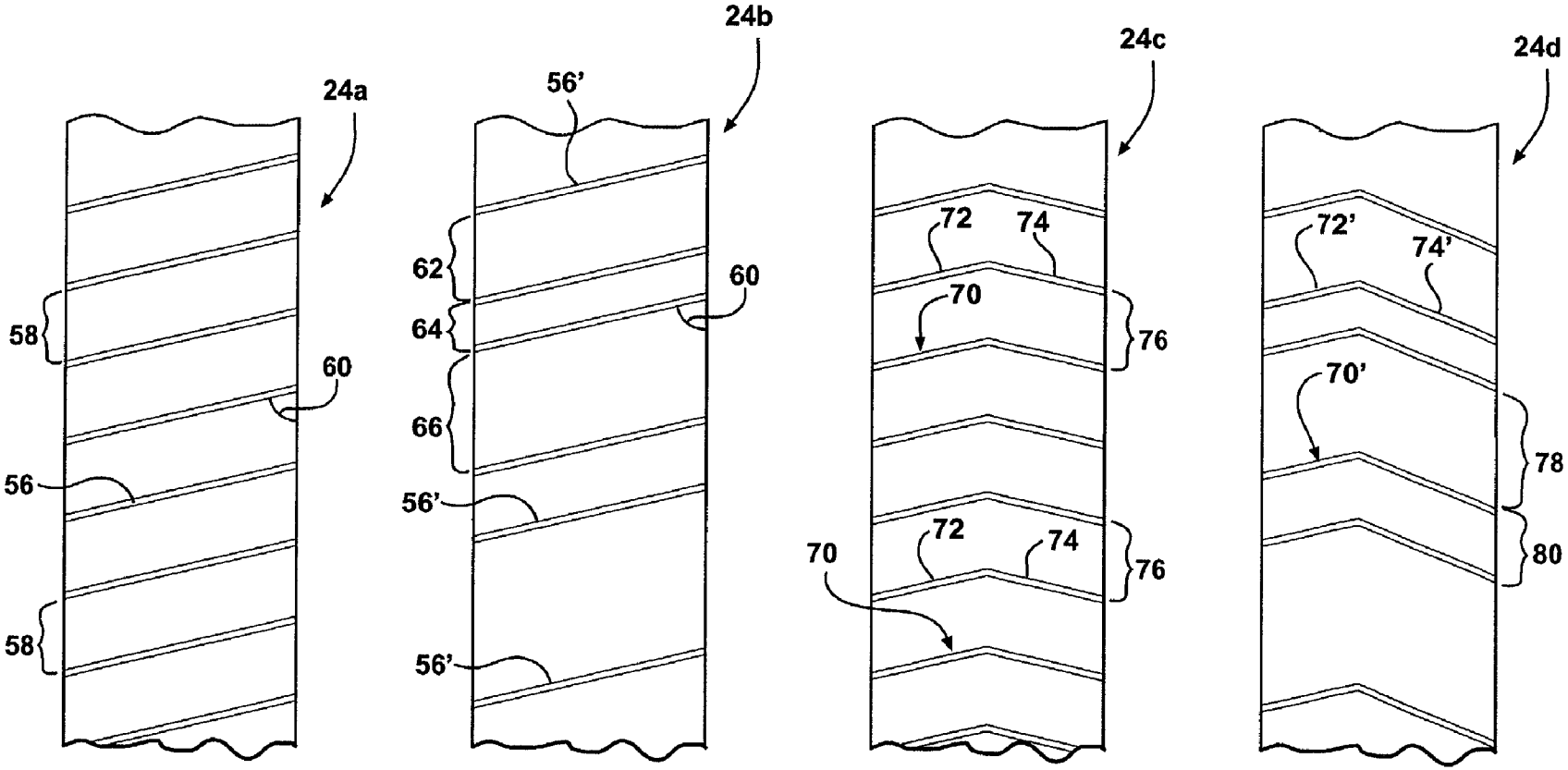
FIG. 3 is a planar, schematic illustration of an alternative groove alignment compared to the embodiment of FIG. 1.
FIG. 4 schematically illustrates another alternative groove alignment.
FIG. 5 schematically illustrates another alternative groove alignment.
FIG. 6 schematically illustrates another alternative groove alignment.

The example of FIG. 4 includes a jacket 24*b* having a plurality of grooves 56'. The grooves 56' are spaced apart using different spacings 62, 64 and 66, for example. The grooves 56' are aligned at an acute angle 60 relative to the longitudinal axis of the belt. The example of FIG. 4 combines the inventive angular alignment of the grooves with the inventive varying spacing strategy, either or both of which can be employed in the present invention.

FIG. 5 illustrates another example belt assembly having a jacket 24*c*. In this example, a plurality of grooves 70 each have a plurality of line segments 72 and 74. In the example of FIG. 5, the grooves 70 are equally spaced using a spacing 76. Because the line segments 72 and 74 are not perpendicular to the longitudinal axis of the belt, the equal spacing does not present the noise generation difficulties provided if the grooves 70 were straight lines that were perpendicular to the longitudinal axis of the belt.

The example of FIG. 6 includes a jacket 24*d* that has a plurality of grooves 70', each of which includes line segments 72' and 74'. In this example, different spacings 78 and 80, for example, separate each of the grooves from an adjacent groove.

Figure 7:
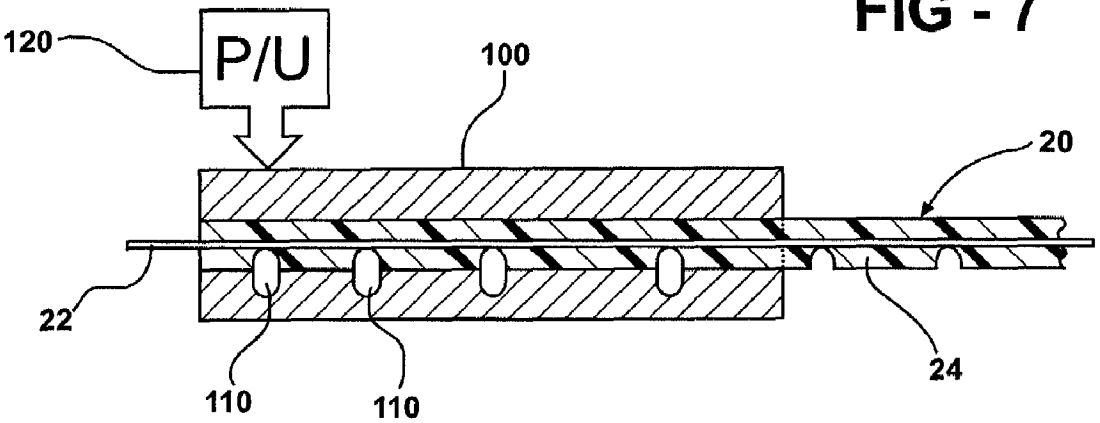
FIG. 7 schematically illustrates a device and method useful for making a belt assembly designed according to an embodiment of this invention.
Figure 8:
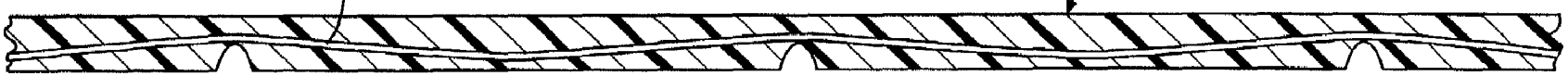
FIG - 8 PRIOR ART
FIG. 8 schematically illustrates a typical cord geometry relative to outer surfaces on a belt jacket according to the prior art.

With reference to FIG. 7, the process of making an elevator belt assembly designed according to this invention is schematically illustrated by machinery 100. The cords 22 move through the machinery 100 which provides a mold for forming the jacket 24.

The machinery 100 includes a plurality of cord supports 110. In the case of forming the belt assemblies of FIGS. 1, 4 and 6, the spacing between the cord supports is variable. Although the spacing between two adjacent cord supports 110 may be the same, it is preferred that the spacing between the cord supports 110 not be arranged in a repeating pattern. Preferably, the spacing should be randomized within an acceptable range that will depend on the machinery.

As the cords 22 are fed through the machinery 100 they are supported on each of the cord supports. In examples where the cords 22 are fed continuously, the cord supports 110 move as the cords 22 are fed through the machinery 100. A polyurethane-based jacket material is fed into the machinery from a reservoir 122 in a conventional manner. As the jacket material envelopes the cords 22, the cord supports cause grooves to be formed in the jacket. The machinery preferably causes an opposite side of the jacket 24 to be flat. The machinery 100 operates in a known manner to extrude, mold or otherwise form the jacket 24 around the cords 22.

Providing different spacing between the cord supports yields different spacing between the grooves along the length of the belt.

In another example, as in forming the belt assemblies of FIGS. 3-6, the cord supports have a configuration that provides a desired groove alignment on the exterior surface of the jacket 24. Example groove configurations and alignments are shown in FIGS. 3-6, but this invention is not limited to those examples.

By placing the grooves in a desired alignment, the difficulties of audible noise generation experienced with conventional coated belt assemblies can be at least greatly reduced and usually eliminated. Providing different spacings between grooves or a properly selected angular alignment of at least a part of each groove, or a combination of both results in a much quieter arrangement.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of making an elevator belt having a plurality of cords within a jacket, comprising the steps of:

(a) aligning the plurality of cords in a selected arrangement; and (b) applying the jacket to the cords while supporting the cords such that the applied jacket includes a plurality of longitudinally spaced grooves formed in the jacket where the grooves are disposed at least in part at an oblique angle to a longitudinal axis of the belt, and spaced at varying longitudinal intervals.

2. The method of claim 1 including spacing the grooves such that three sequential spacings between the grooves are all different from each other.

3. An elevator belt, comprising:

a plurality of cords aligned generally parallel to a longitudinal axis of the belt; and a jacket over the cords and having a plurality of longitudinally spaced grooves on a side of the jacket, the grooves being disposed at least in part at an oblique angle to the longitudinal axis, and spaced at varying longitudinal intervals.

4. The elevator belt of claim 3, wherein three sequential ones of the longitudinal intervals are all different from each other.

5. The elevator belt of claim 3, wherein a first portion of each groove is disposed at a first oblique angle to the longitudinal axis and a second portion of each groove is disposed at a second oblique angle to the longitudinal axis.

6. The belt assembly of claim 3, wherein three sequential ones of the spacings between the grooves are all different from one another.

7. The belt of claim 3, wherein said groove comprises a plurality of line segments and at least one of the segments is at the oblique angle relative to the longitudinal axis of the belt.

8. The belt of claim 7, wherein each line segment of a particular one of the grooves is at a different angle relative to the longitudinal axis.

9. The belt of claim 3, wherein the cords comprise steel wires and the jacket comprises an elastomer.

10. The belt of claim 9, wherein the elastomer comprises polyurethane.

* * * * *